US006367188B1

(12) United States Patent
Vargas

(10) Patent No.: US 6,367,188 B1
(45) Date of Patent: Apr. 9, 2002

(54) FIREARM WITH DETACHABLE MAGAZINE

(75) Inventor: Eugene T. Vargas, Florissant, MO (US)

(73) Assignee: Eugene T. Vargas Revocable Trust, Florissant, MO (US)

( * ) Notice: Subject to any disclaimer, the term of this patent is extended or adjusted under 35 U.S.C. 154(b) by 0 days.

(21) Appl. No.: 09/655,268

(22) Filed: Sep. 5, 2000

(51) Int. Cl.[7] ..... F41C 27/00
(52) U.S. Cl. ..... 42/106; 42/50; 42/47.02
(58) Field of Search ..... 42/106, 50, 49.01, 42/49.02

(56) References Cited

U.S. PATENT DOCUMENTS

| | | | | | |
|---|---|---|---|---|---|
| 2,642,688 | A | * | 6/1953 | Johnson, Jr. | 42/50 |
| 2,715,290 | A | * | 8/1955 | Harvey | 42/50 |
| 2,745,203 | A | * | 5/1956 | Ruple | 42/50 |
| 3,110,122 | A | * | 11/1963 | Musgrave | 42/50 |
| 4,079,535 | A | * | 3/1978 | Elbe et al. | 42/49.02 |
| 4,601,124 | A | * | 7/1986 | Brown, Jr. | 42/75.03 |
| 4,862,618 | A | * | 9/1989 | Szabo | 42/7 |
| 5,056,252 | A | * | 10/1991 | Velezis | 42/50 |
| 5,345,660 | A | * | 9/1994 | Howard | 29/1.3 |
| 5,450,683 | A | * | 9/1995 | Miller, IV | 42/50 |
| 5,495,687 | A | * | 3/1996 | Waiser | 42/50 |
| 5,526,600 | A | * | 6/1996 | Chestnut et al. | 42/50 |
| 5,555,661 | A | * | 9/1996 | Yap | 42/49.02 |
| 5,615,505 | A | * | 4/1997 | Vaid | 42/50 |
| 5,761,841 | A | * | 6/1998 | Snick | 42/50 |

OTHER PUBLICATIONS

The following are pages from Brownells' catalog 2000 showing various followers.

* cited by examiner

*Primary Examiner*—Peter M. Poon
*Assistant Examiner*—Jordan Lofdahl
(74) *Attorney, Agent, or Firm*—Blackwell Sanders Peper Martin LLP

(57) ABSTRACT

A firearm including an action, a barrel and a cartridge magazine. A platform is provided for removably mounting in the magazine to convert the firearm from a repeater to a single shot and to provide improved alignment of the cartridge with the chamber in the barrel.

18 Claims, 2 Drawing Sheets

18
16
28
30
31
80
27
14
26
10
20
12

86
36
38
34
37
42
98
96
100
92
90
32
83
43
82
84
88

FIREARM WITH DETACHABLE MAGAZINE

BACKGROUND OF THE INVENTION

Many rifles are used for target shooting. Their accuracy can be measured by one or more of several methods including the resulting group size or by the score achieved when shooting a scoring target. Regardless of the method of measuring, consistency is key to either small groups or high scores. Numerous devices and procedures have been devised to improve accuracy and target shooters go to great lengths to improve accuracy. A current event is shooting at a range of 1,000 yards with the record for such a range being a group size of less than three inches. To achieve such results, the shooter will take extraordinary steps in ensuring consistency to achieve accuracy. For example, cartridges will be precisely hand loaded. The necks of the cases will be turned for concentricity of the neck opening of the case relative to the chamber. The overall length of the cartridge and in particular the position of the ogive relative to the lands of the rifling will also be carefully controlled. The type of powder, the type of primer, etc. will also be extremely precisely controlled for consistency from shot to shot. One of the important factors in achieving extreme accuracy is the position of the bullet relative to the case. To achieve extreme accuracy, the longitudinal axis of the bullet must be aligned with the longitudinal axis of bore of the barrel when positioned in the chamber. The bullet needs to be as perfectly formed as possible with high concentricity between the jacket and the core and should have no nicks or scratches prior to firing. Further the bullet must be consistently seated to position the ogive relative to the lands on the rifling in the rifle bore to control the distance the bullet moves before contacting the lands (this is often times referred to as bullet jump).

A very popular type of rifle for target shooting is the bolt action rifle. Many target rifles are single shot rifles which allow for precise alignment of the cartridge when advancing it into the chamber by manipulation of the bolt. However, many rifles used for competitive or target shooting are not single shot rifles but have a magazine and are so called repeaters. In fact, many shooting events such as silhouette shooting utilize repeaters. In order for a rifle to be versatile, it would be desirable to be able to use it both as a repeater as well as a single shot with single shot mode being used, for example, when bench rest shooting.

Repeating rifles use a magazine for holding multiple cartridges. In order to reduce the magazine height, the cartridges are stacked in a staggered side to side orientation, i.e., their centerlines are on opposite sides of the centerline of the magazine. Such a magazine will typically include a follower with a deck providing support for the bottom cartridge and an elongate rib that projects upwardly from the deck for supporting the second from bottom cartridge and also forcing the cartridges to be positioned in the staggered side-by-side orientation. Thus, when a cartridge is fed from the magazine to the chamber by forward movement of the bolt, the cartridge enters the chamber at a sideways angle (as viewed from the top of the gun) relative to the longitudinal axis of the chamber and the bore of the barrel instead of longitudinally aligned therewith. Sometimes a lot of force is applied to the bolt to assist in locking the bolt lugs and sometimes in seating the cartridge in the chamber. Such out of alignment loading can cause the bullet to become nicked, and/or forced back into the case further or shifted to an angle out of axial alignment with the longitudinal axis of the case neck. All of these factors can adversely affect accuracy. One solution to preventing such problems is to hand feed a cartridge into the chamber and then close the bolt on it in essence making the gun a single shot. However, with the magazine in place (which keeps a cartridge from falling thru the gun stock), the rib on the follower will stop forward movement of the bolt in many rifles to help in, amongst other things, preventing dry firing of the firearm. This requires that the shooter manually depress the follower to allow forward motion of the bolt to lock the cartridge in the chamber for firing. Such manipulation of the magazine is not only inconvenient but can also shift the rifle on the rests affecting accuracy.

Devices have been made for converting a magazine to a single shot. One such device is sold under the name Score High and fits under the inwardly turned lips at the top of the magazine. However, if the magazine is one that has a ribbed follower, such an insert is supported along only one side and will rock from side to side resulting in potential misalignment of the cartridge as discussed above.

An additional problem with some cartridges is that with large bullet sizes, the overall cartridge length exceeds that which will permit the cartridge to fit between the front and back walls of the magazine. This longer length is oftentimes required to provide the optimum spacing of the bullet to the lands for optimum bullet jump. Thus, they cannot be loaded into the magazine. In target shooting, many times a longer bullet is desirable to improve the ballistics coefficient, which can improve accuracy yet they cannot be loaded into the magazine. Thus, the use of a standard magazine to contain cartridges can limit the variety of cartridges useable in the firearm and may prevent the achievement of optimum bullet jump.

There is, thus, a need for an improved firearm with a convertible magazine to improve its versatility in use and potential accuracy.

SUMMARY OF THE INVENTION

Among the several objects and features of the present invention may be noted the provision of a firearm that can be utilized both as a single shot and a repeater without requiring major modification to the structure of the firearm. The firearm utilizes a magazine capable of holding multiple cartridges that by the provision of an auxiliary platform may be easily converted to a single shot firearm. The platform permits accurate alignment of the cartridge with the chamber of the barrel as well as the bore to reduce the risk of damage to the bullet and the cartridge when being inserted into the chamber for subsequent firing. The platform has a channel for receiving and guiding the cartridge while holding down the magazine follower to allow the bolt to move forward to advance the cartridge without the bolt catching on the follower. The platform also includes at least one spacer, which may be adjustable, to hold the platform securely in position in the magazine. By use of the removable platform, the firearm may be used both as a repeater when needed and as a single shot when needed.

The invention may be practiced as a retrofit to pre-existing rifles without modifying the rifle and alternately may be incorporated into the rifle as originally manufactured.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figures 1, 5:
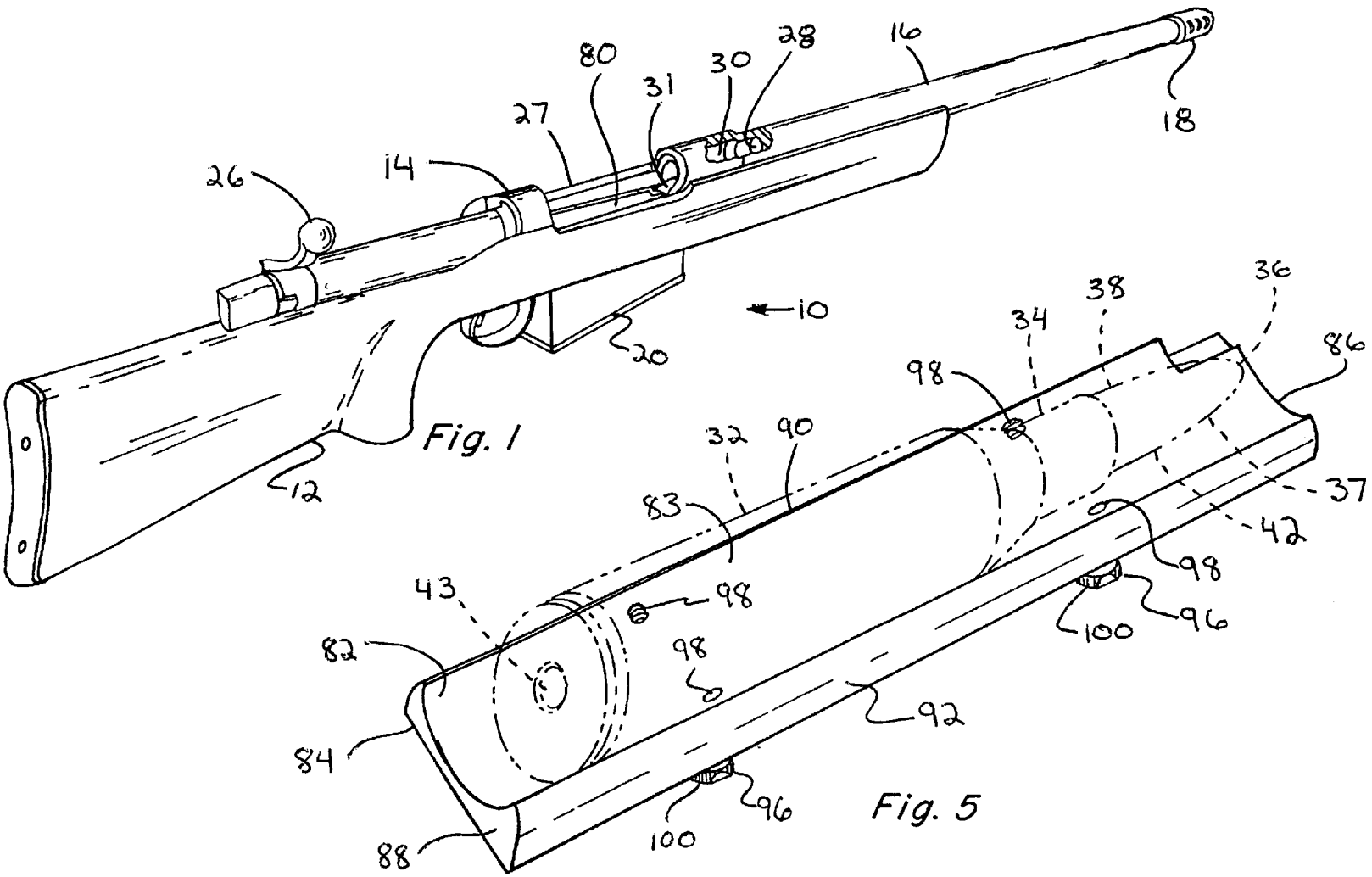
FIG. 1 is a perspective view of a rifle with the bolt open and showing portions of the magazine and with portions broken away to show the barrel chamber and bore.
FIG. 5 is a perspective view of the platform with a cartridge shown in phantom.

FIG. 1 illustrates a repeater style of firearm which, in a preferred embodiment, is a bolt action rifle 10. The rifle 10 includes a stock 12 with an action 14 secured thereto. A barrel 16 is secured to the action 14. In some heavy caliber target rifle, a muzzle blast arrestor 18 can be provided on the free end of the barrel 16. A magazine 20 is mounted in the stock and can contain one or more cartridges 24. The illustrated receiver is a bolt action receiver having a bolt 26 moveably mounted in the receiver 27. The barrel includes a rifled bore 28 and a chamber 30 for receiving a cartridge therein for firing. A small ramp 31 can be positioned forward of the leading end of the magazine 20 and adjacent the rear end of the chamber 30 to lift a cartridge moving into the chamber. The magazine is positioned in front of the lug end of the bolt when the bolt is open and behind the chamber 30. The cartridge 24, such as a centerfire cartridge, typically includes a brass case 32 with a neck 34 having a bullet 36 seated therein. The bullet typically has a tapered nose section 37 and a generally cylindrical section 38. The transition area between the sections 37 and 38 is referred to as the ogive and is denoted by the reference numeral 42. The cartridge contains powder (not shown) and a primer 43 which when struck by the firing pin (not shown but is inside the bolt) ignites the powder which then bums forming gasses that drive the bullet down the barrel 16.

Figure 2:
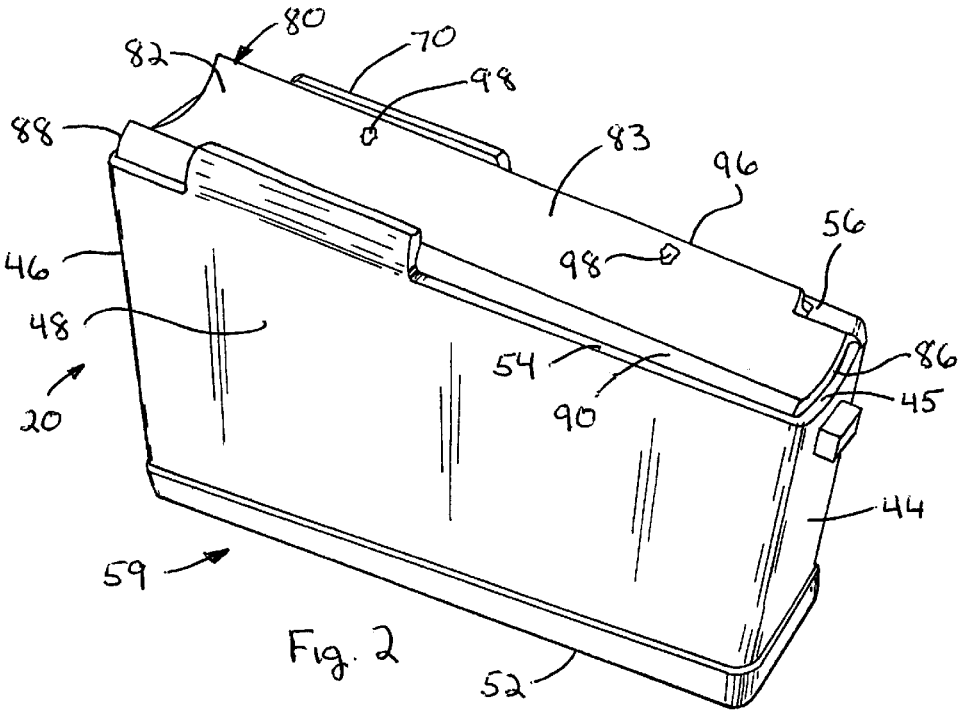
FIG. 2 is a perspective view of the magazine without the platform.
Figure 3:
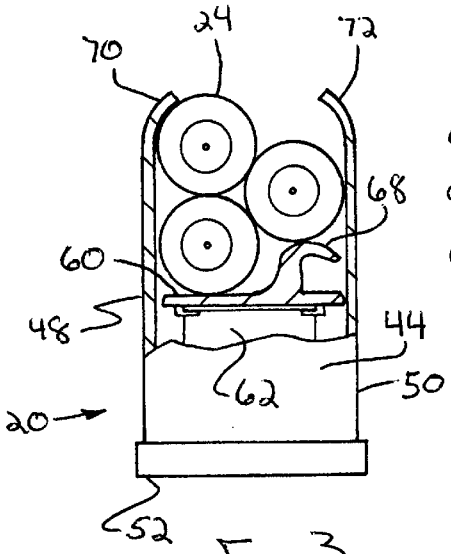
FIG. 3 is an end view of the magazine containing two cartridges with portions of the magazine broken away to show details of the follower and follower spring.
Figure 4:
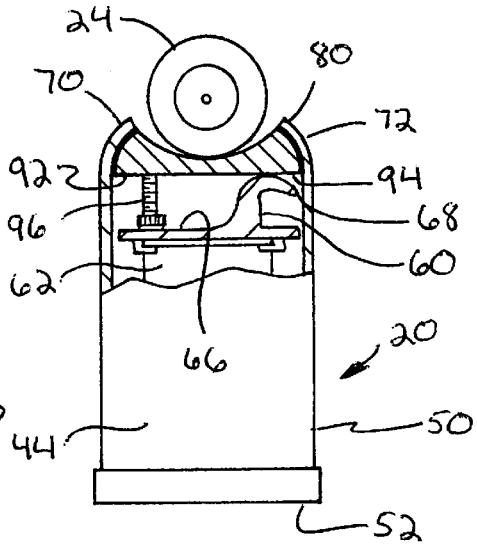
FIG. 4 is an end view of a magazine with portions broken away to show details of the installed platform and a cartridge resting on the platform.

The magazine 20 is shown as an open top detachable magazine and is best seen in FIGS. 2–4. It is to be understood that magazines in various rifle makes and models may take various forms with a representative detachable magazine being shown and described. The magazine 20 includes front and rear walls 44 and 46 respectively and opposite sidewalls 48 and 50. The front wall 44 can have a concave arcuate top edge 45. In some magazines, the sidewalls 48, 50 can converge from the rear wall 46 to the front wall 44. The magazine also includes a bottom wall 52. The sidewalls 48 and 50 have top edges 54 and 56 respectively which can also converge toward the bottom wall 52 from the rear wall 46 toward the front wall 44. This helps accommodate the diameter change of the cartridge from the bullet end to the primer end. The walls 44, 46, 48, 50 and 52 form a housing 59.

As is known, a follower 60 is moveably mounted in the housing 59. The follower moves generally vertically (when the rifle is in the normal shooting position) within the housing and is biased to the upward position by a spring 62 as seen in FIG. 4. Generally, the spring 62 has a series of generally flat sections and in side view, the flat sections form a zigzag between the front wall 44 and the back wall 46 (forming a "Z" shape). Although a "Z" shaped spring is shown, other forms of springs could be used, e.g., a plurality of coil springs could be used. The spring 62 biases the follower 60 and any cartridges contained in the magazine upward as seen in FIG. 3. The follower 60 extends between the walls 44, 46, 48 and 50 and forms a support platform for cartridges contained in the magazine. The follower 60 includes a deck 66 that is preferably generally flat and is positioned on one side of the magazine extending between the front and rear walls 44 and 46 and has a width approximately half of the width of the follower 60. An elongate rib 68 extends between the front and rear walls 44, 46 and also extends upwardly from the deck 66. The deck 66 will support a first cartridge while the rib 68 will support a second cartridge as seen in FIG. 3 so that the cartridges are in staggered relation both side by side and up and down within the magazine 20. Such an arrangement provides for a higher cartridge capacity for a given height of magazine.

The magazine 20 includes a pair of retainers 70 and 72 that are operable for releasably retaining one or more cartridges within the magazine. The follower 60 biases the cartridges upwardly (in the normal gun shooting position) and the retainers 70 and 72, in turn, engage respective cartridges 24 to releasably retain the cartridges in the magazine. In the particular magazine illustrated, the retainers 70 and 72 are inwardly turned elongate lips that extend along at least a portion of the length of the follower 60. When the cartridges 24 are retained normally in the magazine for potential repeating shots, the cartridges are positioned such that their respective center lines are on one side or the other of the longitudinal axis of the bore of the barrel. When the bolt is moved forward, the cartridge moves first at an angle relative to the axis of the bore allowing the bullet to potentially engage the side walls of the chamber and potentially misalign or mar the bullet. In extreme cases, the seating depth of the bullet 36 in the case 32 may also be changed. The rear end (not shown) of the rib 68 will protrude out of the magazine housing 56 for engagement by the bolt to prevent forward motion of the bolt when no cartridge is present to depress the rib.

A platform 80, as best seen in FIGS. 4 and 5, is provided for the reversible conversion of the firearm from a repeater to a single shot. The platform guides the cartridge into the chamber in a manner to reduce the risk of damage to the bullet or change the alignment of the bullet within the neck 34 of the case 32. The platform 80 has top and bottom surfaces 82 and 84 respectively. The top surface 82 forms an upwardly opening channel 83 that has a longitudinal axis generally parallel to and in line with the longitudinal axis of the bore and chamber of the rifle at least in a generally vertical plane (when the gun is in its normal shooting position) through both the bore and chamber axis. In some rifles, the longitudinal axis of the cartridge could be in substantial alignment with the longitudinal axis of the chamber and bore in a generally vertically plane as described and a plane orthogonal thereto passing through the bore and chamber axis, i.e., it would be preferred to have the longitudinal axis of the cartridge substantially in line with (coaxial) the longitudinal axis of the of the bore and chamber (the longitudinal axes of the bore and chamber are also coaxial). This would eliminate the need for the ramp 31. The channel may be generally arcuate in transverse cross section and is concave. The channel is shaped and positioned so as not to stop advancing the bolt toward the chamber when a cartridge is not present. Preferably the channel extends the entire length of the platform and is continuous between its opposite ends which are preferably open. Alternate transverse shapes can be provided, for example, the channel can be generally V-shaped. The cartridge will rest in the bottom of the channel with the gun in its normal shooting position. The platform also has front and rear edges 86 and 88 respectively and opposite side edges 90 and 92. The platform is sized to be received within the housing 59 between the walls 44, 46, 48 and 50. The platform 80 is removably mounted in the magazine. As shown in FIG. 4, the retainers 70 and 72 extend over the top surface 82 along the side edges 90 and 92 of the platform to releasably retain the platform within the magazine. Insertion of the platform can be easily accomplished by simply placing the platform at an angle such that it can move between the retainers 70, 72 then leveling the position of the platform once it is in the magazine such that the top surface 82 will be captured under the retainers 70 and 72.

Figure 6:
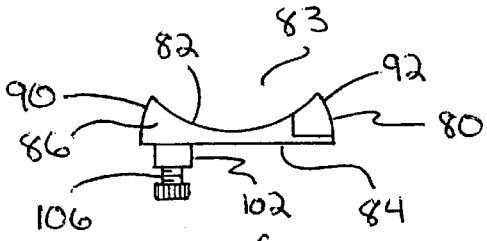
FIG. 6 is an end view of an alternate platform.

As seen in FIGS. 4 and 5, a spacer is provided to retain one side edge portion 92 in fixed spaced relation from the deck 66 while the other side edge portion 94 rests on the top of the rib 68. In the illustrated structure, the spacer includes a pair of threaded columns 96 such as alien head cap screws extending downwardly from the bottom surface 84. The columns 96 are each received in a threaded aperture 98 such that the spacing between the bottom surface (and also the top of the side edge 92) and the free end 100 of the column 96 is adjustable. Although two columns are known, for short cartridges, one may suffice. If desired, for additional adjustability, posts 102 or a rib can be provided on the bottom surface for deeper apertures 98 (FIG. 6). The use of adjustable spacers allows for precise fitting of a platform 80 to a magazine 20. An alternate embodiment would dispense with the columns 96 and have the height of the posts 102 or rib substantially equal to the height of the follower rib 68.

The spacer ensures appropriate positioning of the platform in the magazine and prevents rocking of the platform by applying an upward force to both sides of the platform. The spring 62 provides an upward bias of the platform and retains it firmly in engagement with the retainers 70, 72.

While one form of firearm has been shown, other forms of firearms may be able to utilize the invention. Also, a detachable magazine is illustrated but the platform may be utilized with non-detachable magazines as well.

In view of the above, it will be seen that the several objects of the invention are achieved and other advantageous results attained.

When introducing elements of the present invention, or the preferred embodiment(s), thereof, the articles a, and, the, and said are intended to mean there are one or more of the elements. The terms comprising, including and having are intended to be inclusive and mean that there may be additional elements other than the listed elements.

As various changes could be made in the above construction without departing from the scope of the invention, it is intended that all matter contained in the above description or shown in the accompanying drawings shall be interpreted as illustrative and not in a limiting sense.

What is claimed is:

1. A rifle with a magazine for holding cartridges, said rifle comprising:

(a) a barrel with a bore and a chamber;

(b) an action for inserting a cartridge into and extracting a cartridge from the chamber and retaining a cartridge in the chamber during firing of the cartridge;

(c) a magazine associated with the action and operable for releasably retaining at least one cartridge in normal operation and having a follower for supporting the cartridge, said magazine having an open top and retainers operable to releasably retain a cartridge in the magazine; and (d) a platform removably mounted in said magazine and supported in the magazine by the follower, said platform having a bottom surface and a top surface, said top surface having an upwardly opening channel and being adapted for supporting and guiding a cartridge, said platform having at least one spacer projecting from the bottom surface for engaging the follower whereby said platform is supported adjacent both side edges thereof and is releasably retained in the magazine by the retainers.

2. A rifle as set forth in claim 1 wherein said rifle is a bolt action rifle and said magazine is detachable.

3. A rifle as set forth in claim 2 wherein said top surface is arcuate in transverse cross-section and forms said channel.

4. A rifle as set forth in claim 2 wherein said top surface is generally V shaped and forms said channel.

5. A rifle as set forth in claim 2 wherein said platform is positioned to permit forward movement of the bolt when a cartridge is present on the platform and when a cartridge is not present on the platform.

6. A rifle as set forth in claim 2 wherein said channel is longitudinally aligned with said chamber in a generally vertical plane.

7. A rifle as set forth in claim 1 wherein said rifle is a bolt action rifle and said spacer is adjustable.

8. A rifle as set forth in claim 7 wherein said spacer includes at least one screw projecting from the bottom surface of the platform.

9. A rifle as set forth in claim 8 wherein said channel is longitudinally aligned with said chamber in a generally vertical plane and said platform is positioned to permit forward movement of the bolt when a cartridge is present on the platform and when a cartridge is not present on the platform.

10. A platform for converting a rifle from a repeater to a single shot, said platform being adapted to reversibly modify a rifle magazine, the magazine having a follower with a longitudinally extending rib and a deck, said platform comprising:

(a) an elongate member with the front and rear edges and side edges extending between the front and rear edges, said member having a top surface forming a concave channel with a longitudinal axis extending between the front and rear edges and having a bottom surface with a portion adapted to rest on the rib adjacent one side edge of the member; and (b) at least one spacer for cooperating with the deck and the member to maintain a spaced relation between the deck and the bottom surface of the member.

11. A platform as set forth in claim 10 wherein said at least one spacer is adjustable for adjusting the spacing between the bottom surface and the deck.

12. A platform as set forth in claim 11 wherein said magazine is a detachable magazine.

13. A platform as set forth in claim 11 wherein said spacer includes at least one threaded member threadably engaged in an aperture in said platform.

14. A platform as set forth in claim 13 wherein there is a plurality of said threaded member, each threaded member is mounted in a respective threaded aperture in the platform.

15. A platform as set forth in claim 10 wherein said top surface is generally arcuate in transverse cross-section and is concave forming the channel.

16. A platform as set forth in claim 15 wherein said spacer is adjustable for adjusting the spacing between the bottom surface and the deck.

17. A platform as set forth in claim 16 wherein said channel has opposite open ends and extends the entire length of the platform.

18. A platform as set forth in claim 17 wherein said spacer includes at least one screw threadably mounted on said platform and extending from said bottom surface.

* * * * *